United States Patent [19]

Stiles

[11] 3,958,767

[45] May 25, 1976

[54] MOBILE ROCK COLLECTING AND CRUSHING

[76] Inventor: Edward Stiles, R.D. 2, Mechanicville, N.Y. 12118

[22] Filed: Feb. 18, 1975

[21] Appl. No.: 550,490

[52] U.S. Cl. ..... 241/101.7; 241/263; 241/265

[51] Int. Cl.[2] ..... B02C 1/02

[58] Field of Search ..... 241/101.7, 262, 263, 241/264, 265; 198/12; 214/508, 509

[56] References Cited

UNITED STATES PATENTS

| | | | |
|---|---|---|---|
| 350,494 | 10/1886 | Low | 241/264 |
| 357,568 | 2/1887 | Brennan, Jr. | 241/262 |
| 2,002,224 | 5/1935 | Eastwood | 241/263 |
| 2,920,736 | 1/1960 | Kamarainen | 198/12 |
| 3,103,754 | 9/1963 | Wieger | 198/12 |
| 3,530,912 | 9/1970 | Freeman | 241/101.7 |
| 3,772,985 | 11/1973 | Girten | 241/262 X |

FOREIGN PATENTS OR APPLICATIONS

| | | | |
|---|---|---|---|
| 555,352 | 7/1932 | Germany | 241/265 |

*Primary Examiner*—Granville Y. Custer, Jr.
*Assistant Examiner*—Howard N. Goldberg
*Attorney, Agent, or Firm*—Pollock, Vande Sande & Priddy

[57] ABSTRACT

A mobile rock collecting and crushing apparatus is disclosed which is specially adapted to be drawn behind and powered by a farm or garden tractor, for collecting rocks from fields, crushing them and expelling the crushed rock back to the field. The conventional power take-off shaft at the rear of the tractor turns a common drive shaft for reciprocating crushing blocks and for a rock collector and elevator. Provision is made for adjusting the fineness of the crushed rock expelled from the machine.

10 Claims, 5 Drawing Figures

MOBILE ROCK COLLECTING AND CRUSHING

BACKGROUND OF THE INVENTION

For centuries, agricultural workers have been plagued with the problem of removing oversized rocks from their fields to facilitate cultivation and reduce wear and tear on cultivating implements. Numerous prior art devices have been produced to pick up and collect or, in some instances, crush rocks lying on or near the surface of such fields. Unfortunately, where the rocks are only picked up and collected, their ultimate disposal may be a problem for the farmer having limited space in which to discard them. This is especially so in regions where fields must be cleared of rocks annually. Where provision has been made for crushing the collected rocks, the machinery used generally has been too large, too heavy and too expensive for use by many small agricultural businesses, such as small farmers, landscapers and the like.

Thus, a need exists for a simple, inexpensive device which may be readily drawn behind and powered by a conventional farm or garden tractor, for picking up, crushing and disposing of rocks found in agricultural fields. Preferably, such a device should be operable by a single person. It should be adjustable to vary the size of the crushed rock returned to the field, in keeping with the intended use of the field. The device should be easily transportable to a field over normal roadways, and should be of simple construction to permit routine maintenance by the owner or user.

OBJECTS OF THE INVENTION

An object of this invention is to provide a simple, easily portable apparatus for picking up and crushing rocks from agricultural fields.

Another object is to provide such a device in which the crushed rocks are returned to the field.

A further object of the invention is to provide such a crushing apparatus in which size may be easily adjusted for crushed rocks returned to field.

Yet another object of the invention is to provide such a device which may be drawn by and powered by a conventional farm or garden tractor, under the surveillance of a single person.

The above objects of the invention are intended to be merely exemplary; thus, other desirable objectives inherently achieved by the invention may occur to those skilled in the art. However, the scope of the invention is to be limited only by the appended claims.

SUMMARY OF THE INVENTION

The above and other objects of the invention are achieved by the disclosed device, which may comprise at least one axle and wheel assembly for supporting the apparatus in motion. A plurality of support rail members and a drawbar support rail are attached to the axle and wheel assembly. A pair of crusher blocks are reciprocably mounted on the support rail members and means for collecting and elevating rocks to be crushed are pivoted to the support rails in position to deposit collected rocks into a crushing volume defined between the crusher blocks. Means for driving the collecting and elevating means and for reciprocating the crusher blocks are also provided. The invention also may include means for adjusting the fineness of the crushed rock.

DETAILED DESCRIPTION OF THE PREFERRED EMBODIMENT

Figure 1:
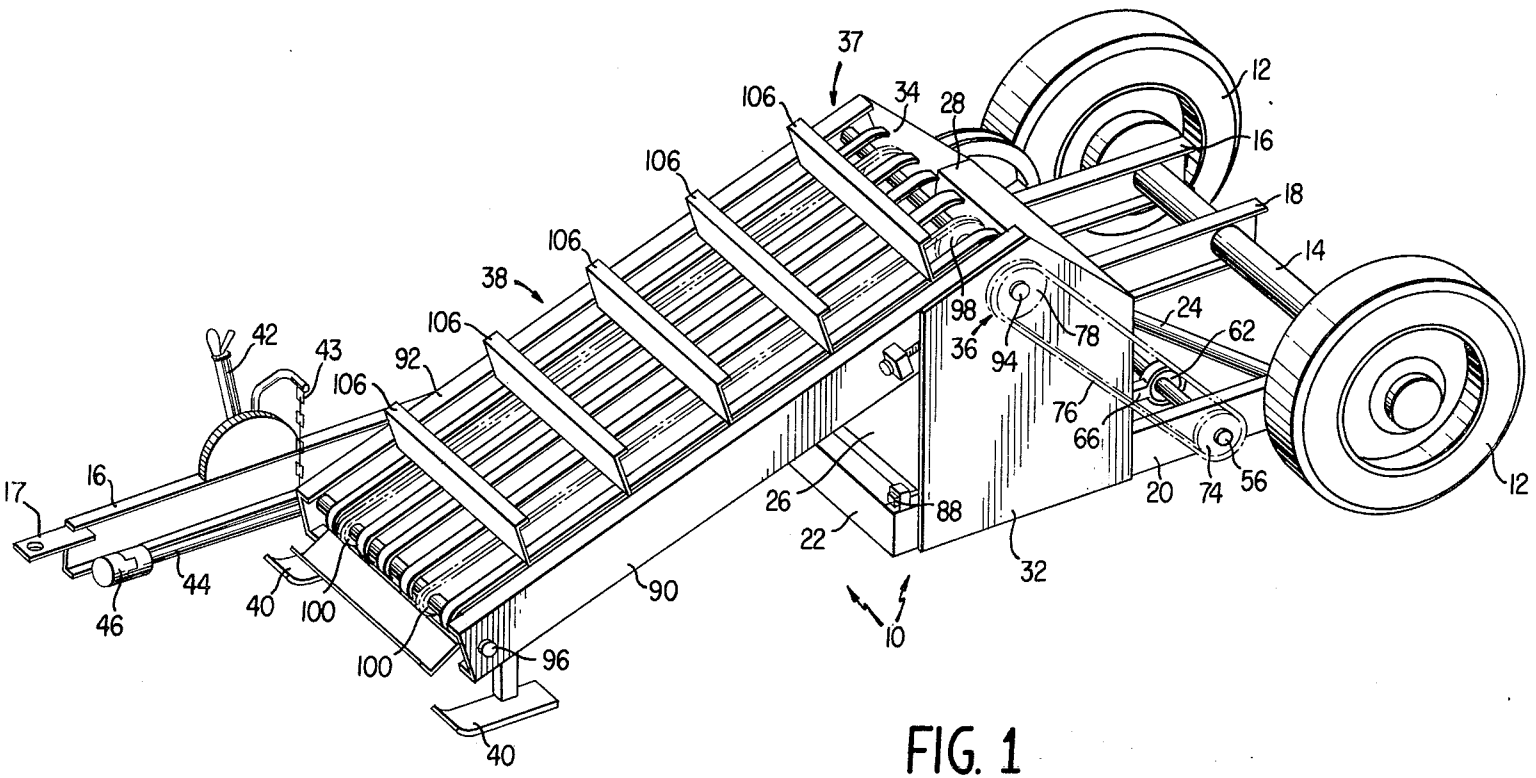
FIG. 1 shows a perspective view of the invention, taken from the left front.

There follows a detailed description of a preferred embodiment of the invention, reference being had to the drawings in which like reference numerals identify like elements of structure in each of the several Figures.

Figure 2:
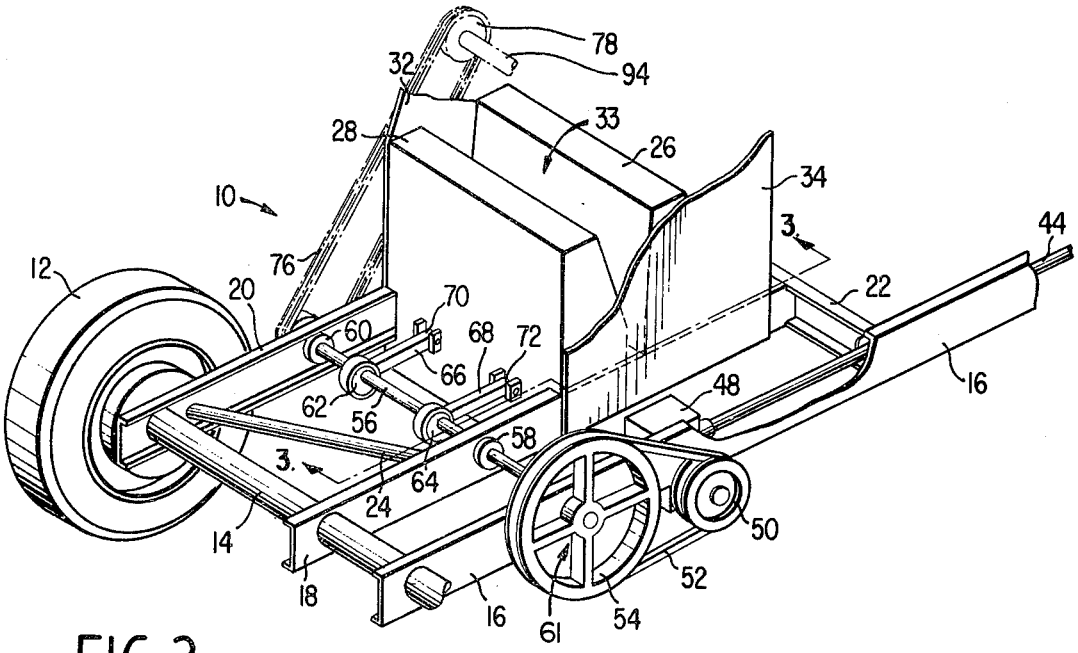
FIG. 2 shows a perspective view of the invention, partially cut away, taken from the right rear.

Referring to FIGS. 1 and 2, front and rear perspective views of the invention are seen. The mobile rock collector and crusher 10 according to the invention includes a pair of ground support wheels 12 connected by a tubular axle 14 or the like which joins the rear ends of a drawbar or rail 16 having a tractor hitch 17 at its forward end, and two side rails or bars 18 and 20 extending essentially parallel with drawbar 16. As indicated, the drawbar and side rails may be of conventional structural iron and are shown as having the well known C-shaped cross section. Tubular axle 14 is shown as extending through each of the drawbar 16 and side rails 18 and 20; however, it is also possible to attach tubular axle 14 to the upper or lower surfaces of these elements using conventional U-bolts, as will be familiar to those in the mechanical arts. A transverse rail 22 of similar cross section joins the forward end of side rails 18 and 20 and is also rigidly connected to drawbar 16 at a location midway of its ends. A brace bar 24 extends diagonally from side rails 20 to side rail 18 to provide additional rigidity. These elements define the main supporting frame of the apparatus.

Mounted on this frame are front crusher block 26 and rear crusher block 28 adapted for sliding motion along side rails 18 and 20. Crusher blocks 26 and 28 may be formed from reinforced concrete having a sheet steel or iron covering over their crushing surfaces or may be formed of solid malleable iron, as preferred. Each crusher block includes a longitudinal slot in its right and left vertical sides which slidably receives side rails 18 and 20, as will be discussed in greater detail with regard to FIG. 3. A left side wall 32 and a right side wall 34, of steel plate or similar durable construction, are suitably attached to side rails 18 and 20 and extend vertically along the right and left sides of front and rear crusher blocks 26 and 28 to define a crushing volume 33 between the crusher blocks and the side walls.

Located near the upper edge of side walls 32 and 34 above the upper edges of the crusher block are transversely opposed pivot support points 36 and 37, to which the upper end of rock collector and elevator 38 is pivotally attached. Skids 40 support the lower end of collector and elevator 38 when it is lowered into contact with the underlying ground. The vertical height of skids 40 may be adjusted as necessary to vary the height of the lower end above the underlying ground, when the apparatus is in use. A height adjustment lever 42 having a conventional locking latch pawl supports the lower end of rock collector and elevator 38 above the surface of the underlying ground via a chain 43, when the apparatus is being transported. Also, height adjustment lever 42 may be used to provide additional adjustment of the clearance between the lower end of rock collector and elevator 38 and the underlying ground.

A drive shaft 44 extends from the front of the apparatus approximately parallel to drawbar 16 and includes a rotating coupling 46 which may be connected to the rear power take-off of a conventional farm or garden tractor. Drive shaft 44 passes to the rear of the apparatus through an opening in transverse rail 22 and is connected to gear box 48, attached to drawbar 16. Reduction gear box 48 transfers the direction of rotation through 90° to pulley or sprocket 50 which is connected via a belt or chain 52 to fly wheel 54. Fly wheel 54 is drivingly connected to a transverse power shaft 56 which is journaled at 58, 60 and 61 for rotation in side rails 18 and 20 and drawbar 16. As in the case of tubular axle 14, transverse power shaft 56 may also be mounted on the upper or lower surfaces of side rails 18 and 20 and drawbar 16, as desired. When transverse power shaft 56 is mounted as indicated, journals 58, 60 and 61 are chosen to be easily removable from side rails 18 and 20 and drawbar 16 to facilitate installation and removal of transverse power shaft 56. Between side rails 18 and 20, transverse power shaft 56 includes eccentric crank throws 62 and 64 rigidly attached thereto which rotatably receive the crank end of connecting rods 66 and 68. The wrist pin ends of connecting rods 66 and 68 are, in turn, pivoted to rear crusher block 28 as indicated at 70 and 72. Attached to the left end of transverse power shaft 56 on the outboard side of side rail 20 is drive sprocket 74 which meshes with, for example, a 4 inch block chain 76 which, in turn, meshes with drive sprocket 78 of rock collector and elevator 38.

Figure 3:
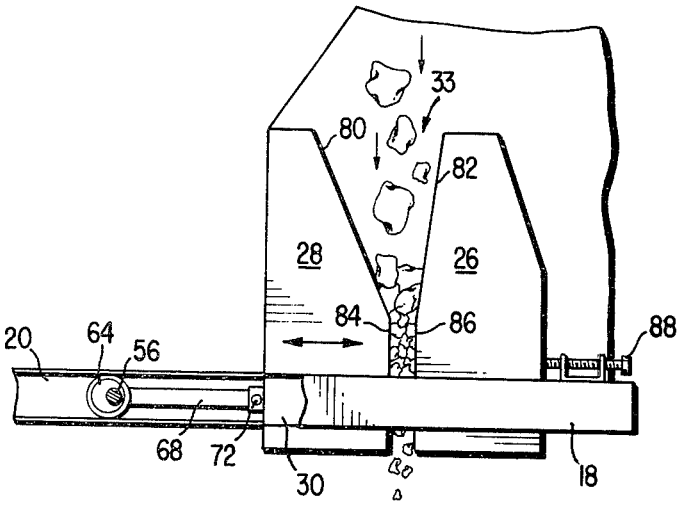
FIG. 3 shows an elevation, partially in section and partially cut away, taken along line 3—3 of FIG. 2.

FIG. 3 shows the interior geometry of crushing volume 33. Rear crusher block 28 includes a forwardly inclined crushing face 80 and front crushing block 26 includes a rearwardly inclined crushing face 82. Faces 80 and 82 terminate in essentially vertical crushing faces 84 and 86 which extend to the bottom of crushing blocks 26 and 28. The position of forward crusher block 26 is variably fixed by adjustment bolts 88 which are attached to either side of block 26 and threadingly mounted to side rails 18 and 20, as indicated. By adjusting the position of bolts 88, the force and aft position of the front crusher block may be adjusted, thereby changing the clearance between blocks 26 and 28 when rear crusher block 28 is in its forward-most position. FIG. 3 also indicates more clearly the longitudinal slots 30 in the crusher blocks which slidingly receive side rails 18 and 20. To minimize friction between the side rails and the crusher blocks, the surfaces of slot 30 and the surfaces of side rails 18 and 20 upon which the crusher blocks ride are smoothly finished and may be lubricated with a heavy grease. In instances where crusher blocks of particularly large proportions are used, it is desirable to provide linear bearings either on the upper surface of side rails 18 and 20 or on the inside surface of slots 30, to minimize friction therebetween.

Figure 5:
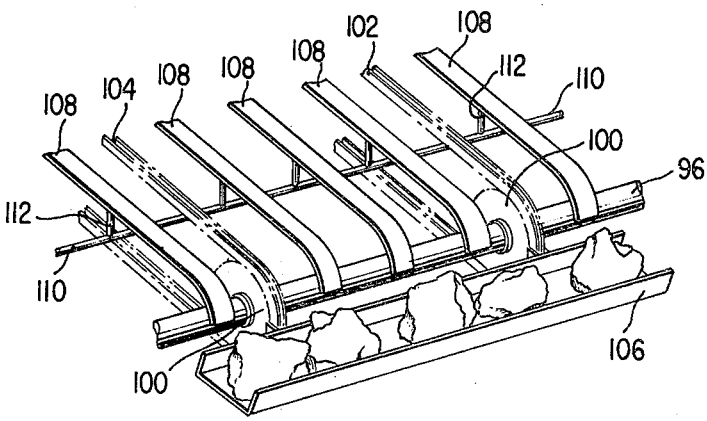
FIG. 5 shows a partial perspective view of the rock collector and elevator of the invention, taken from the right front.
Figure 4:
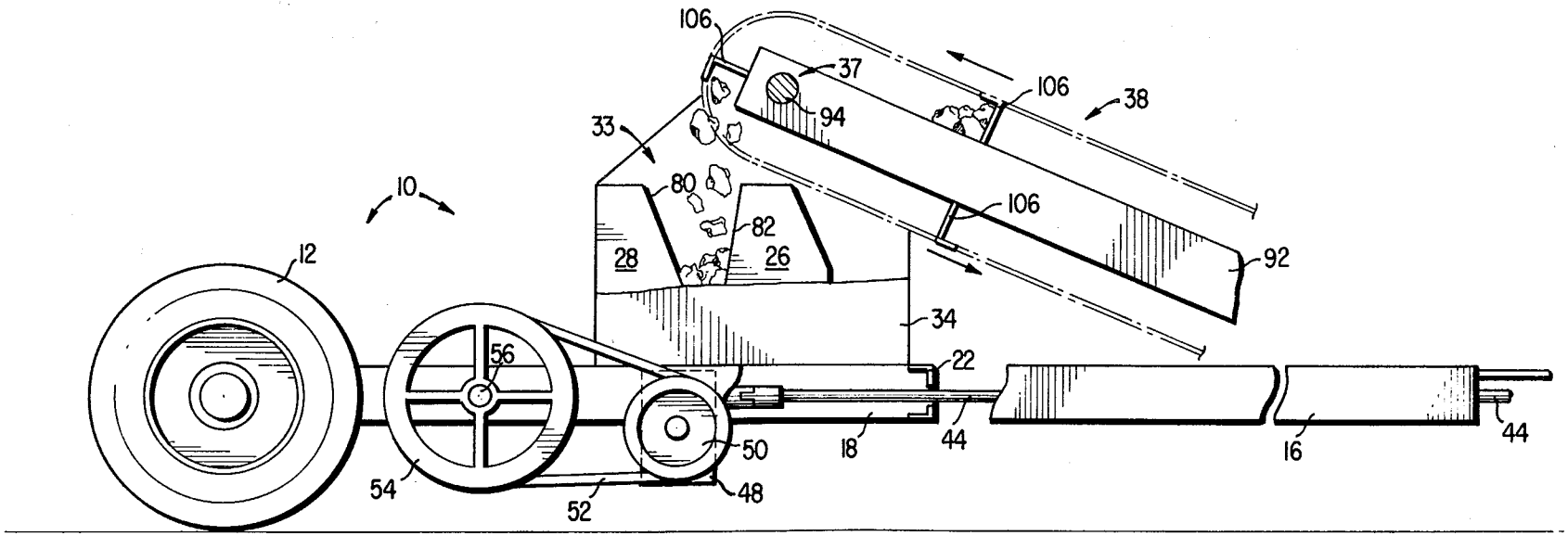
FIG. 4 shows a partial side elevation of the invention, taken from the right side.

Referring now to FIGS. 1, 4 and 5, the structure of rock collector and elevator 38 may be understood.

Rock collector and elevator 38 includes a pair of elongated frame rails 90 and 92 which are joined at their upper and lower ends by axles 94 and 96, journaled for rotation therein. Drive sprocket 78 is attached to the outboard or left end of axle 94. Spaced upper and lower sprocket wheels 98 and 100 are mounted on axles 94 and 96 to drive a pair of endless chains 102 and 104. A plurality of elongated rock collecting scoops 106 are rigidly attached to endless chains 102 and 104 for movement therewith. As indicated, rock collecting scoops 106 of are U-shaped cross section and are oriented on chains 102 and 104 so that rocks on the underlying ground surface will be picked up within the U-shaped cross section and carried upward toward crushing volume 33. Axle 94 is placed above and somewhat forward of crushing volume 33, whereby rocks carried upward by scoops 106 are readily deposited in the crushing volume, yet adequate clearance between scoops 106 and forward crusher block 26 is ensured.

Referring particularly to FIG. 5, a plurality of slats 108 are provided over which rock collecting scoops 106 move when the apparatus is in use. The spaces between slats 108 permit rocks of acceptably small size and soil carried upward by rock collecting scoops 106 to return to the underlying ground surface. A plurality of lateral support rods 110 are located at spaced locations between elongated frame rails 90 and 92 and include upwardly extending support studs 112 which support slats 108 and maintain them in position relative to endless chains 102 and 104 and rock collecting scoops 106.

In operation, hitch 17 is attached to the tractor and rotating coupling 46 is attached to the power take-off shaft of the tractor. When the apparatus has reached the location at which rocks are to be collected and crushed, height adjustment lever 42 may be moved as necessary to provide the desired clearance between rock collecting scoops 106 and the underlying ground surface. Usually, the rock collecting and elevating mechanism 38 will be lowered until skids 40 are resting on the underlying ground surface. As the tractor moves across the field, power is transmitted to shaft 44 which drives transverse power transverse shaft 56 via gear box 48, pulley 50, belt 52 and fly wheel 54. As transverse power shaft 56 rotates, eccentric crank throws 62 and 64 cause rear crusher block 28 to reciprocate along rails 18 and 20. Simultaneously, sprocket 74, chain 76 and drive sprocket 78 cause upper shaft 94 to rotate, thereby causing endless chains 102 and 104 to move continuously over sprockets 98 and 100. As chains 102 and 104 move, rock collecting scoops 106 are cause to scrape along or beneath the surface of the soil, thereby entraining any rocks at that location. Scoops 106 are spaced on their chains as necessary to ensure that the entire ground surface is properly treated. As rock collecting scoops 106 move up rock collector and elevator 38, small rocks, clumps of earch and fine granular material drop between slats 108, while large rocks and clumps of earth are carried upward and thrown or dumped into crushing volume 33, as indicated in FIGS. 3 and 4. Within crushing volume 33, the reciprocating motion of rear crusher block 28 causes the clumps and rocks to be crushed and the resultant rock particles and earth to be expelled from the apparatus to the underlying ground surface.

Those skilled in the art will realize that the ground surface will of necessity have to be broken before the inventive apparatus may be used in order to loosen the soil and facilitate rock removal. Thus, it is within the scope of the invention to use the device in conjunction with a conventional spring tooth or disc harrow or other ground breaking means for this purpose. Also, it is apparent that the device may be used as a stationary crusher when desired.

Having described my invention in sufficient detail to enable one of ordinary skill in the art to make and use it,

I claim:

1. A mobile rock collecting and crushing apparatus, comprising:

at least one axle and wheel assembly for supporting said apparatus in motion;

at least one support rail member attached to said axle and wheel assembly;

a pair of crusher blocks reciprocably mounted on said at least one support rail member, said crusher blocks defining a crushing volume therebetween within which said rocks are crushed;

a drive shaft rotatably mounted to said at least one support rail member adjacent said crusher blocks;

means driven by said drive shaft for reciprocating one of said crusher blocks relative to said at least one support rail member;

a rock collecting and elevating means pivotably mounted to said at least one support rail member for collecting rocks from an underlying surface and depositing them in said crushing volume; and means driven by said drive shaft for operating said collecting and elevating means.

2. An apparatus as described in claim 1, further comprising means mounted to said at least one support rail member for pivoting said collecting and elevating means toward or way from said underlying surface.

3. An apparatus as described in claim 1, wherein there are two support rail members connected at one end to said axle and wheel assembly for reciprocably supporting said crusher blocks, a support rail drawbar connected at one end to said axle and wheel assembly and a transverse support rail connected to the other ends of said two support rail members and to said support rail drawbar.

4. An apparatus as described in claim 1, wherein said crushing volume is convergent toward said underlying surface, there being a minimum clearance established between said crusher blocks, and means for adjusting said minimum clearance by moving the other of said crusher blocks relative to said at least one support rail member, whereby the coarseness of the crushed rock may be varied.

5. An apparatus as described in claim 1, wherein said drive shaft is adapted to receive power from a source exterior to the apparatus and said means for reciprocating one of said crusher blocks comprises at least one connecting rod pivotably connected to said one crusher block, shaft means driven by said drive shaft and at least one eccentric crank throw mounted on said shaft and rotatably received by said connecting rod.

6. An apparatus as described in claim 1, wherein said rock collecting and elevating means comprises an elongated frame pivotably connected at one end to said at least one support rail member at a location above said crushing volume, skid means connected to said elongated frame at the other end, at least one endless chain mounted for movement about sprockets mounted on shafts at either end of said elongated frame and a plurality of elongated rock collecting scoops attached to said endless chain.

7. An apparatus as described in claim 6, wherein said means for operating said collecting and elevating means comprises shaft means driven by said drive shaft, a sprocket connected to said shaft means and a second endless chain operatively connected to at least one of said shafts at either end of said elongated frame.

8. An apparatus as claimed in claim 7, wherein said drive shaft is adapted to receive power from a source exterior to the apparatus and said means for reciprocating one of said crusher blocks comprises at least one connecting rod pivotably connected to said one crusher block and at least one eccentric crank throw mounted on said shaft and rotatably received by said connecting rod.

9. An apparatus as described in claim 6, further comprising means mounted to said at least one support rail member and operatively connected to said elongated frame for pivoting said collecting and elevating means toward or away from said underlying surface.

10. An apparatus as described in claim 6, further comprising means for adjusting the clearance between said rock collecting scoops and said underlying surface.

* * * * *